US007523733B2

(12) United States Patent
Moore

(10) Patent No.: US 7,523,733 B2
(45) Date of Patent: Apr. 28, 2009

(54) DUAL INTAKE VALVE ASSEMBLY FOR INTERNAL COMBUSTION ENGINE

(75) Inventor: Ralph Moore, 190 E. Park Ave., Wassila, AK (US) 99654

(73) Assignees: Ralph Moore, Wasilla, AK (US); Randall Z. Bonnell, Palmer, AK (US)

( * ) Notice: Subject to any disclaimer, the term of this patent is extended or adjusted under 35 U.S.C. 154(b) by 27 days.

(21) Appl. No.: 11/857,527

(22) Filed: Sep. 19, 2007

(65) Prior Publication Data

US 2008/0230031 A1 Sep. 25, 2008

Related U.S. Application Data

(60) Provisional application No. 60/918,911, filed on Mar. 20, 2007.

(51) Int. Cl.
*F02N 3/00* (2006.01)

(52) U.S. Cl. ..... 123/188.2; 123/188.4

(58) Field of Classification Search ..... 123/79 C, 123/188.4, 188.15, 188.2
See application file for complete search history.

(56) References Cited

U.S. PATENT DOCUMENTS 1,728,500 A 9/1929 Martorell
1,868,138 A 7/1932 Fisk
3,881,459 A 5/1975 Gaetcke
3,903,855 A 9/1975 Klakulak et al.
3,987,769 A 10/1976 Yew
3,995,609 A 12/1976 Klomp
4,084,554 A 4/1978 Bohnlein
4,094,277 A 6/1978 Goto et al.
4,836,154 A 6/1989 Bergeron
4,901,683 A 2/1990 Huff
5,085,179 A 2/1992 Faulkner
5,357,914 A 10/1994 Huff
5,782,215 A 7/1998 Engelmann
6,237,549 B1 5/2001 Huff

*Primary Examiner*—Noah Kamen
(74) *Attorney, Agent, or Firm*—Berenato, White & Stavish, LLC

(57) ABSTRACT

An intake valve assembly of an internal combustion engine that includes a combustion chamber and an intake passage. The intake valve assembly comprises a primary valve provided to seal against a primary valve seat formed in an intake port, a secondary valve mounted about the primary valve coaxially therewith and provided to seal against a secondary valve seat formed in the intake port, and a secondary valve lifter fixed to the primary valve so as to be axially spaced from the secondary valve when both the primary and secondary valves are in closed positions. The secondary valve is operated mechanically by the secondary valve lifter and fluidly in response to pressure differential between the intake passage and the combustion chamber.

20 Claims, 13 Drawing Sheets

Fig. 14
Prior Art

| RPM | Torque (ft-lb) | Power (HP) | Exhaust Gas Temp. (°F) | Head Temp (°F) | Oil Temp (°F) |
|---|---|---|---|---|---|
| 1600 | 11.91 | 3.733 | 995 | 416 | 232 |
| 1800 | 12.50 | 4.323 | 1041 | 419 | 234 |
| 2000 | 12.81 | 4.870 | 1036 | 419 | 234 |
| 2200 | 13.08 | 5.427 | 1067 | 420 | 234 |
| 2400 | 13.17 | 6.076 | 1090 | 421 | 236 |
| 2600 | 13.40 | 6.708 | 1132 | 424 | 238 |
| 2800 | 13.53 | 7.318 | 1154 | 425 | 240 |
| 3000 | 13.42 | 7.667 | 1181 | 424 | 242 |
| 3200 | 13.28 | 8.136 | 1220 | 421 | 245 |
| 3400 | 13.04 | 8.433 | 1215 | 421 | 246 |
| 3600 | 13.14 | 9.007 | 1215 | 419 | 244 |
| 3800 | 12.63 | 9.169 | 1243 | 411 | 252 |

Fig. 15

| RPM | Torque (ft-lb) | Power (HP) | Exhaust Gas Temp. (°F) | Head Temp (°F) | Oil Temp (°F) |
|---|---|---|---|---|---|
| 1600 | 13.78 | 4.305 | 1105 | 393 | 220 |
| 1800 | 14.99 | 5.168 | 1100 | 393 | 220 |
| 2000 | 15.47 | 5.949 | 1129 | 388 | 220 |
| 2200 | 15.59 | 6.665 | 1159 | 382 | 220 |
| 2400 | 15.73 | 7.172 | 1168 | 383 | 219 |
| 2600 | 15.60 | 7.643 | 1190 | 381 | 219 |
| 2800 | 15.16 | 8.041 | 1211 | 379 | 218 |
| 3000 | 15.17 | 8.642 | 1240 | 373 | 220 |
| 3200 | 14.56 | 9.000 | 1258 | 370 | 221 |
| 3400 | 14.42 | 9.377 | 1262 | 372 | 221 |
| 3600 | 13.94 | 9.571 | 1291 | 368 | 223 |
| 3800 | 13.36 | 9.708 | 1287 | 363 | 224 |

DUAL INTAKE VALVE ASSEMBLY FOR INTERNAL COMBUSTION ENGINE

CROSS-REFERENCE TO RELATED APPLICATION

This application claims the benefit under 35 U.S.C. 119(e) of U.S. Provisional Application No. 60/918,911 filed Mar. 20, 2007 by Ralph Moore.

BACKGROUND OF THE INVENTION

1. Field of the Invention

The present invention relates to internal combustion engines in general and, more particularly, to an intake valve assembly of an internal combustion engine.

2. Description of the Prior Art

In a conventional internal combustion engine, intake and exhaust poppet valves regulate the gas exchange. A valve train (i.e. cams, drive gears and chains, rocker arms, push rods, lifters, etc.) regulate the poppet valves. Fixed valve timing of the poppet valves of the conventional internal combustion engine, and especially of the intake valve, represents a compromise between two conflicting design objectives: 1) maximum effective pressure within a cylinder, thus torque, at the most desirable points in a range of engine operating speeds, and 2) a highest possible power peak output. The higher the RPM at which maximum power occurs, and the wider the range of an engine operating speed, the less satisfactory will be the ultimate compromise. Large variations in the effective flow opening of the intake valve relative to the stroke (i.e., in design featuring more than two valves) will intensify this tendency.

In conventional four-stroke internal combustion engines, during the ending phase of the exhaust stroke, both intake and exhaust valves to the combustion chamber are kept open simultaneously for a certain period (known in the art as a valve overlap period, or simply a valve overlap) in order to increase exhaust efficiency of the engine. However, as a consequence of both valves being open simultaneously, part of the exhaust gas burnt in the combustion chamber is blown past the open intake valve and into an intake passage of the engine where the exhaust gas is mixed with the air-fuel mixture flowing through the intake passage. The exhaust gases impair ignition of the air-fuel mixture and therefore adversely affect the engine performance. The instability and accompanying inefficiency are particularly acute in the medium to low speed operational ranges of the engine and during idling of the engine.

Typically, a range of engine operating speeds includes a low engine speed range (low engine speeds) and a high engine speed range (high engine speeds). Generally, the low engine speed range is defined as a speed range from an idle speed to a midrange speed, and high engine speed is defined as a speed range from the midrange speed to a maximum engine speed. In other words, the low engine speed is the engine speed at or near the lower end of the operating speed range of the engine, while the high engine speed is the engine speed at or near the upper end of the operating speed range of the engine.

At the same time, growing demand for minimizing exhaust emissions and maximizing fuel economy means that a low idle speed and high low-end torque along with high specific output of an internal combustion engine are becoming increasingly important. These imperatives have led to the application of variable valve timing systems (especially for intake valves). However, this approach is complex and expensive, and takes away from durability of the internal combustion engine. Moreover, effectiveness of the variable valve timing systems that regulate the valve train is limited to a downstream efficiency of the poppet valve. The poppet valve is far from ideal. Even when the valve is open, a disk-shaped head of the poppet valve is directly in front of an intake port opening, where it sits directly in the way of the air or air/gas mixture flow stream. However, currently, the poppet valve is the only kind of valve that can operate in the severe environment of the internal combustion engine.

Thus, the intake valve assembly of the prior art, including but not limited to those discussed above, are susceptible to improvements that may enhance their performance and cost. The need therefore exists for intake valve assembly that is simple in design, compact in construction and cost effective in manufacturing, and, at the same time, provides both an improved low-end torque along with a high power output of the internal combustion engine.

SUMMARY OF THE INVENTION

The present invention provides a novel intake valve assembly for an internal combustion engine that includes a combustion chamber and an intake passage fluidly communicating with the combustion chamber through an intake port.

The intake valve assembly of the present invention comprises a primary valve provided to seal against a primary valve seat formed in the intake port, and a hollow secondary valve mounted about the primary valve substantially coaxially therewith and provided to seal against a secondary valve seat formed in the intake port. The primary valve is movable into and out of engagement with the primary valve seat between respective closed and open positions, while the secondary valve is movable into and out of engagement with the secondary valve seat between respective closed and open positions. The intake valve assembly further comprises a secondary valve lifter fixed to the primary valve so as to be axially spaced from the secondary valve when both the primary valve and the secondary valve are in the closed position.

The primary valve is operated only mechanically, while the secondary valve is operated both mechanically by the secondary valve lifter and fluidly in response to pressure differential between the intake passage and the combustion chamber. The secondary valve is engagable with the primary valve through the secondary valve lifter after opening of the primary valve so that further movement of the primary valve away from the primary valve seat pushes the secondary valve away from the secondary valve seat.

Therefore, the present invention provides a novel dual intake valve assembly of an internal combustion engine that provides in effect a variable valve timing and significantly improves both low and high speed performance of the engine. Moreover, the present invention reduces cost and complexity of the valve assembly and valve train compared to the existing (conventional) variable valve timing systems, and requires minimal low cost modification to adapt the intake valve assembly of the present invention to existing engines.

BRIEF DESCRIPTION OF THE DRAWINGS

Other objects and advantages of the present invention will become apparent from a study of the following specification when viewed in light of the accompanying drawings, wherein:

FIG. 14 shows dynamometer test results for the conventional stock engine; and FIG. 15 shows dynamometer test results for the engine equipped with the intake valve assembly of the present invention.

DESCRIPTION OF THE PREFERRED EMBODIMENTS

Figure 1:
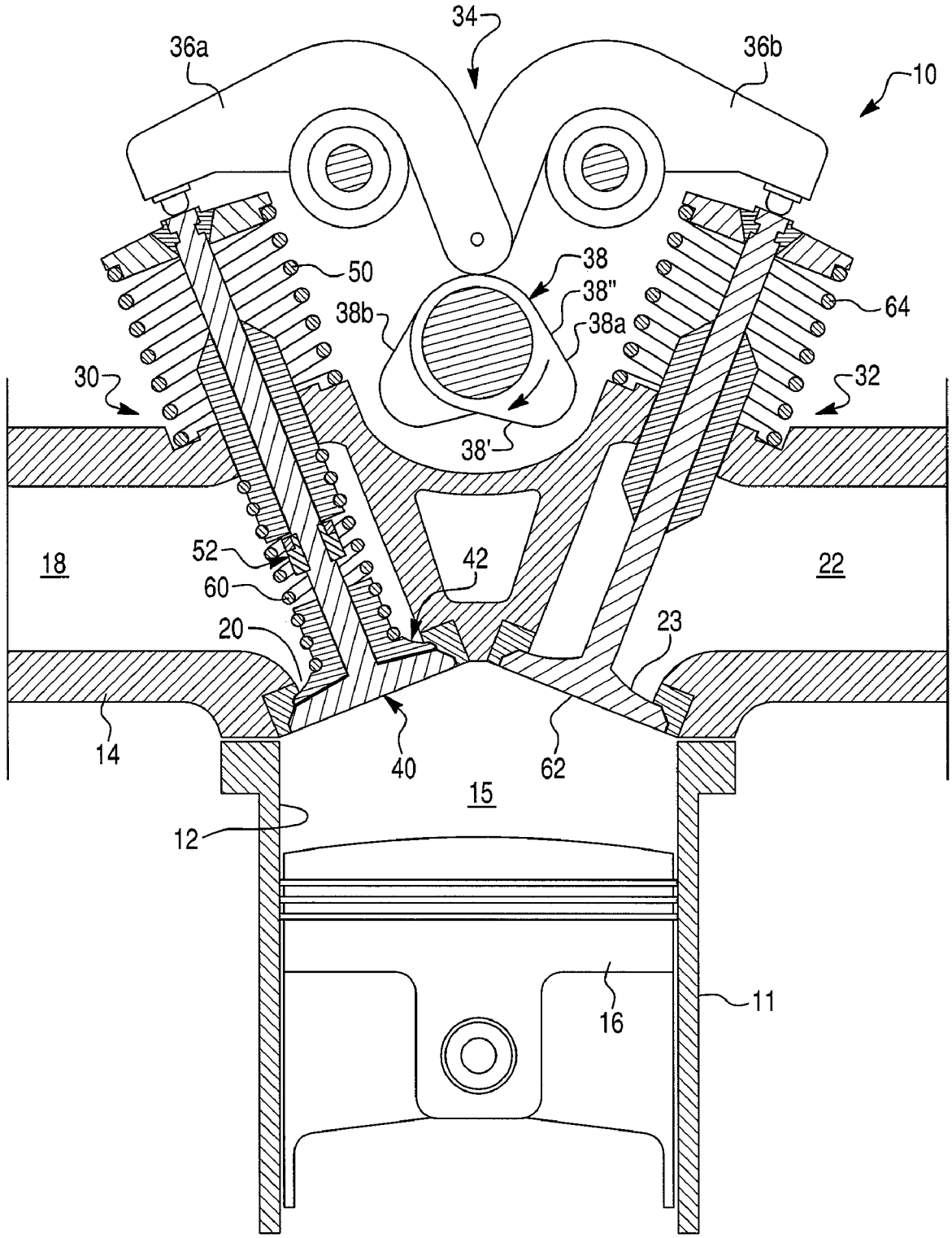
FIG. 1 is a fragmentary, sectional transverse view of an internal combustion engine comprising an intake valve assembly according to the present invention.

The preferred embodiments of the present invention will now be described with the reference to accompanying drawing.

For purposes of the following description, certain terminology is used in the following description for convenience only and is not limiting. The words such as "upper" and "lower", "left" and "right", "inwardly" and "outwardly" designate directions in the drawings to which reference is made. The words "smaller" and "larger" refer to relative size of elements of the apparatus of the present invention and designated portions thereof. The terminology includes the words specifically mentioned above, derivatives thereof and words of similar import. Additionally, the word "a", as used in the claims, means "at least one".

Referring to FIG. 1 of the drawings, a preferred embodiment of an internal combustion engine of the present invention, generally denoted by reference numeral 10, is illustrated.

Figure 2:
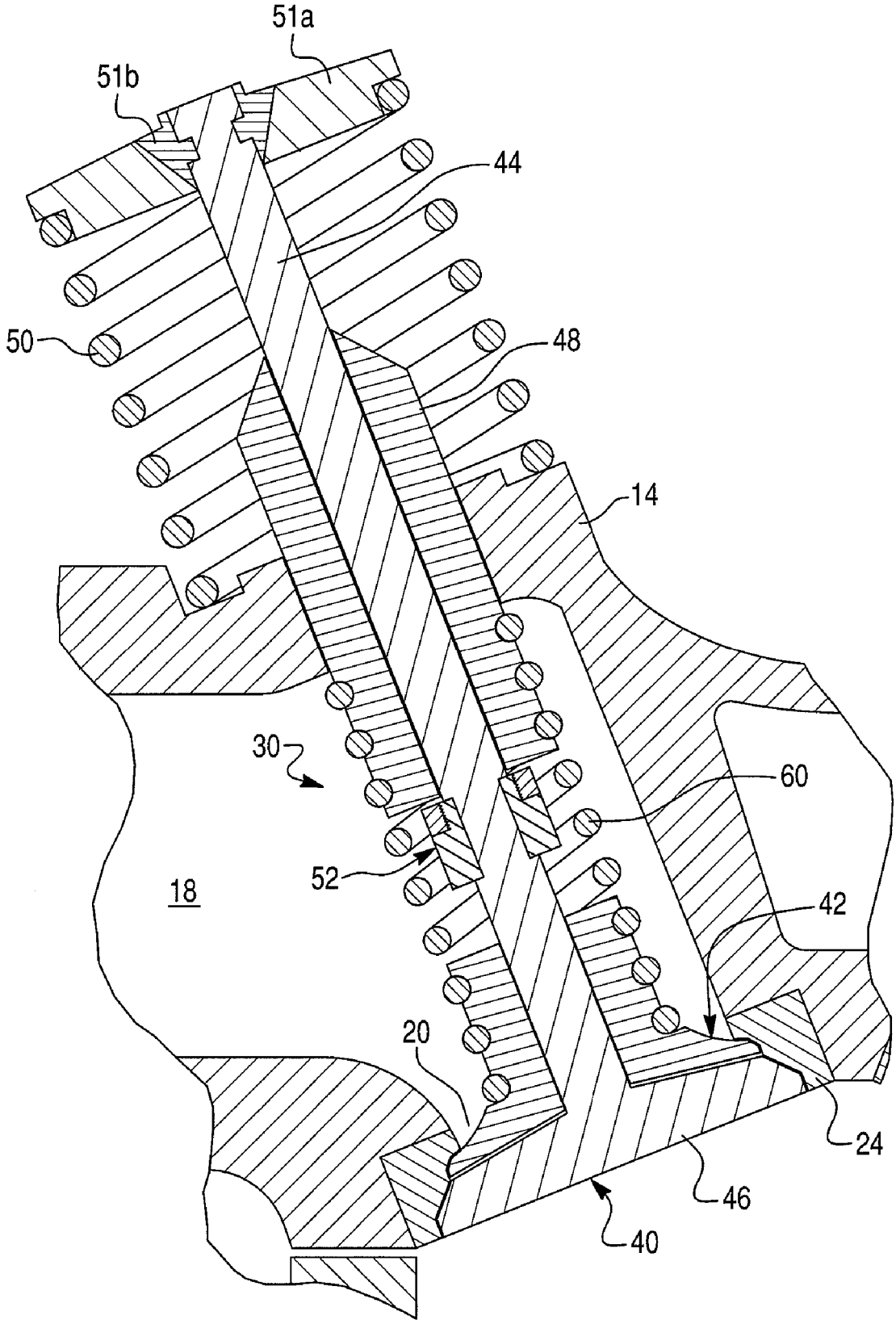
FIG. 2 is a sectional view of the intake valve assembly according to a preferred embodiment of the present invention with both primary valve and secondary valve in a closed position.
Figure 3:
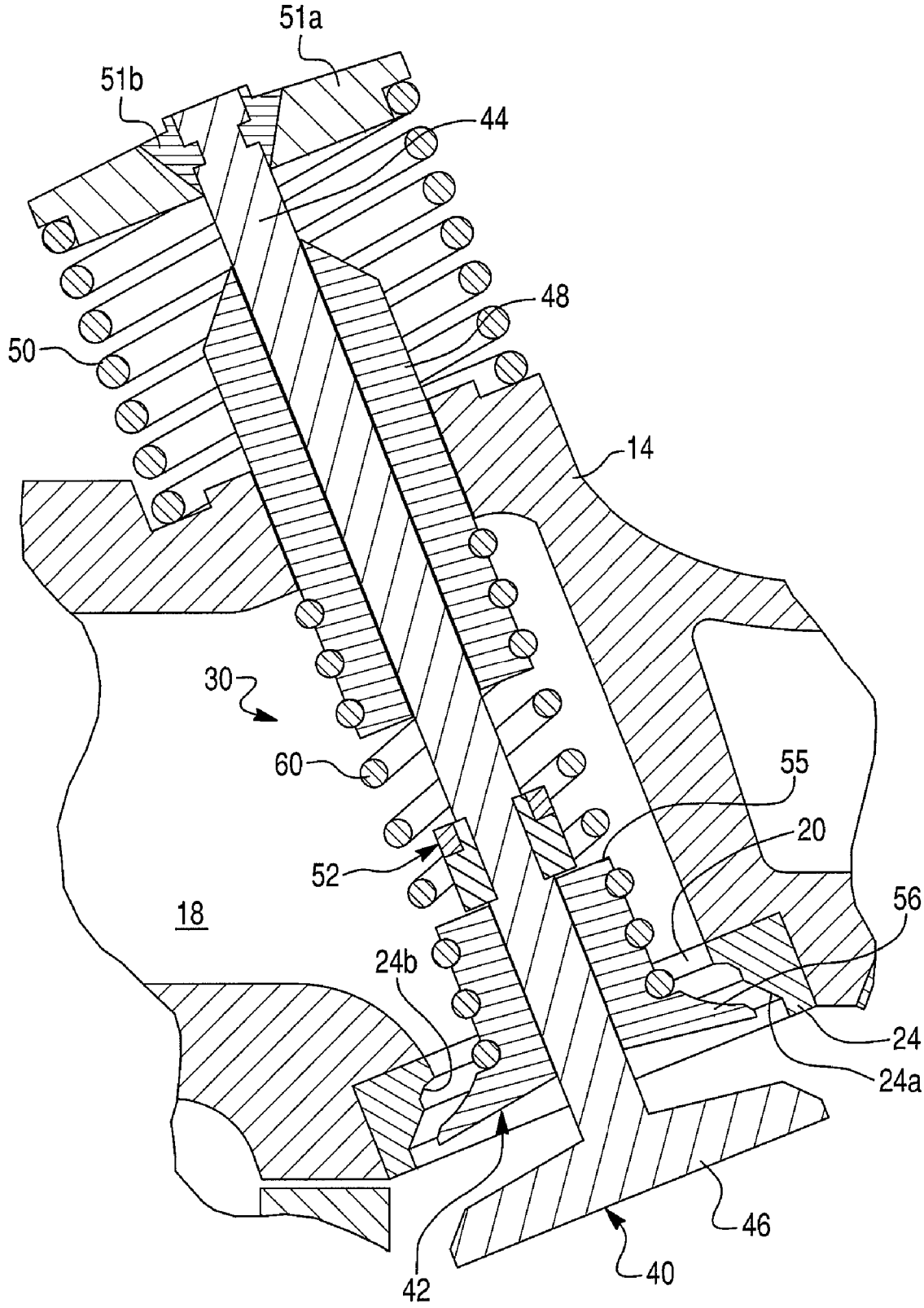
FIG. 3 is a sectional view of the intake valve assembly according to the preferred embodiment of the present invention with both primary valve and secondary valve in an open position.
Figure 4:
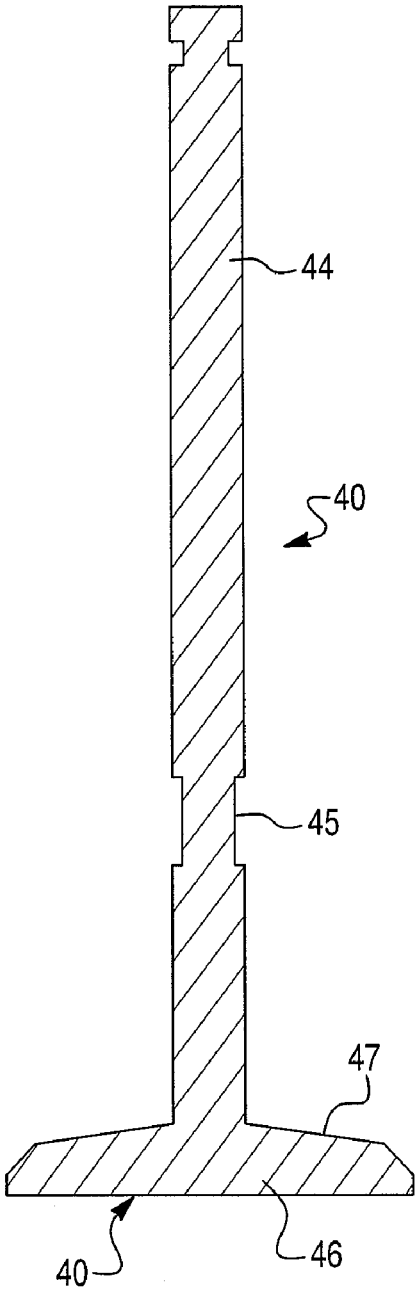
FIG. 4 is a cross-sectional view of a primary poppet valve of the intake valve assembly according to the preferred embodiment of the present invention.
Figure 5:
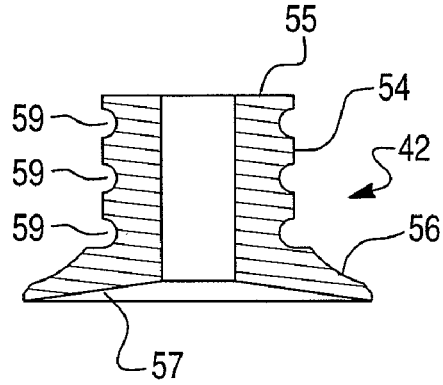
FIG. 5 is a cross-sectional view of a secondary poppet valve of the intake valve assembly according to the preferred embodiment of the present invention.
Figure 6:
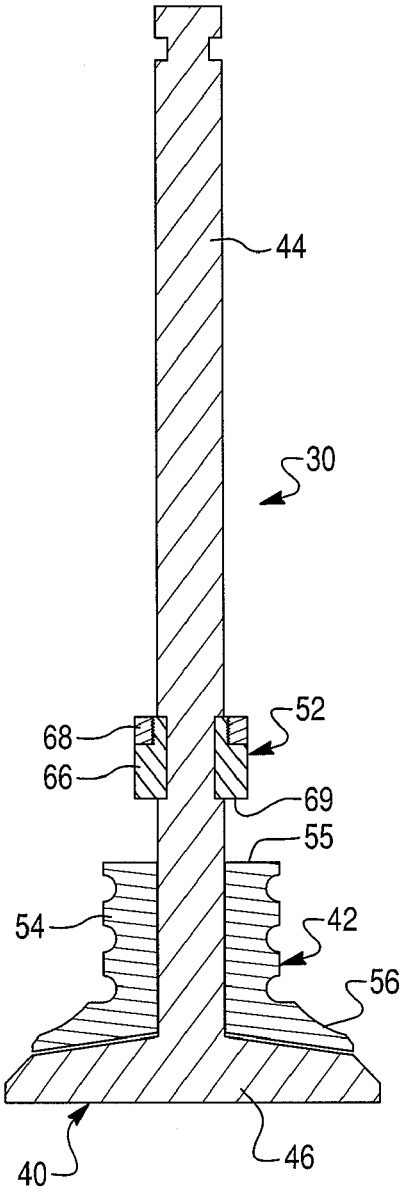
FIG. 6 is a cross-sectional view of the intake valve assembly according to the preferred embodiment of the present invention showing the secondary poppet valve and a secondary valve lifter mounted to the primary poppet valve according to the preferred embodiment of the present invention.

The engine 10 comprises a cylinder block 11 defining at least one hollow cylinder 12, a cylinder head 14 fastened to the cylinder block 11 to seal the upper end of the cylinder 12, and a piston 16 reciprocatingly mounted in the cylinder 12 and, in turn, conventionally connected to a crankshaft through a connecting rod (not shown). The cylinder 12 of the cylinder block 11, the cylinder head 14 and the piston 16 define a combustion chamber 15. The cylinder head 14 is provided with an intake passage 18 fluidly communicating with the combustion chamber 15 through an intake port 20, and an exhaust passage 22 fluidly communicating with the combustion chamber 15 through an exhaust port 23. As further illustrated in detail in FIGS. 2 and 3, the intake port is defined by a substantially annular valve seat member 24 secured to the cylinder head 14. The valve seat member 24 has a first (or primary) substantially annular valve seat 24*a* and a second (or secondary) substantially annular valve seat 24*b* (best shown in FIG. 3. As illustrated in FIGS. 2 and 3, the primary valve seat 24*a* is larger in cross-section than the secondary valve seat 24*b*. Moreover, as used herein, the term "gas" or "fluid" will refer to an air or air/fuel mixture flowing through the intake passage 18 into the combustion chamber 15 through the intake port 20.

The engine 10 further comprises an intake valve assembly 30, an exhaust valve assembly 32, and a valve train (or valve actuating mechanism) 34 provided for actuating the intake and exhaust valve assemblies 30 and 32. The valve train 34, illustrated in FIG. 1, includes a first (intake) rocker arm 36*a* actuating the intake valve assembly 30, a second (exhaust) rocker arm 36*b* actuating the exhaust valve assembly 32, and a valve actuating cam 38. In turn, the cam 38 has a first (intake) lobe 38*a* actuating the first rocker arm 36*a* and a second (exhaust) lobe 38*b* actuating the second rocker arm 36*b*. The intake cam lobe 38*a* has a fixed cam profile including a leading (opening) flank 38' and a trailing (closing) flank 38". Rotation of the crankshaft (not shown) causes the piston 16 to reciprocate in the cylinder 11 and the valve actuating mechanism 34 to operate in conventional manner to perform the known four-stroke engine operating cycle comprising intake, compression, expansion and exhaust strokes.

As illustrated in detail in FIGS. 2-4, 6 and 7, the intake valve assembly 30 according to the present invention comprises a primary poppet valve 40 and a secondary poppet valve 42 mounted about the primary poppet valve 40 substantially coaxially therewith. The primary poppet valve 40 includes an elongated valve stem 44 and a disk-shaped primary valve head 46 provided at a lower end of the valve stem 44 for sealingly engaging the valve seat member 24. The intake valve assembly 30 further includes a valve guide 48 supporting the valve stem 44 of the primary poppet valve 40 for reciprocatingly sliding in the cylinder head 14. The valve guide 48 is fixed in the cylinder head 14 in any appropriate manner known in the art, such by press-fit connection.

The primary valve head 46 is movable into and out of engagement with the valve seat member 24 between respective closed and open positions of the primary poppet valve 40. In the closed position, the primary valve head 46 of the primary poppet valve 40 engages the primary valve seat 24*a* of the valve seat member 24 (as shown in FIGS. 1 and 2), while in the open position thereof the primary valve head 46 is axially spaced from the primary valve seat 24*a* (a shown in FIGS. 3, 8, 9, 10 and 11). The primary poppet valve 40 is biased toward the closed position thereof by a primary valve spring 50 which engages an upper end of the valve stem 44 using a conventional valve spring holder 51*a* and a keeper 51*b*. Preferably, the primary valve spring 50 is in the form of a coils spring mounted concentric to the valve stem 44 of the primary poppet valve 40. Moreover, the primary valve head 46 of the primary poppet valve 40 is complementary to the primary valve seat 24*a*. Accordingly, when the primary valve head 46 of the primary poppet valve 40 engages the primary valve seat 24*a* of the valve seat member 24 in the closed position thereof (shown in FIGS. 1 and 2), the intake port 20 is blocked and the combustion chamber 15 is hermetically sealed from the intake passage 18.

The secondary poppet valve 42, illustrated in detail in FIGS. 2, 3 and 5-7, includes a hollow stem portion 54 and a secondary valve head 56 provided at a lower end of the stem portion 54 for sealingly engaging the valve seat member 24. The secondary valve head 56 is conical or dome-shaped with a front surface 57 thereof configured to complement and nest over a back surface 47 of the valve head 46 of the primary poppet valve 40, as illustrated in detail in FIG. 5. The hollow stem portion 54 defines a substantially cylindrical bore 58 extending through both the stem portion 54 and the secondary valve head 56 of the secondary poppet valve 42. Consequently, the hollow stem portion 54 of the secondary poppet valve 42 is reciprocatingly and coaxially mounted to and about the valve stem 44 of the primary poppet valve 40 to allow the secondary valve head 56 to slide back and forth between the valve seat member 24 of the intake port 20 and the primary valve bead 46 of the primary poppet valve 40.

The secondary valve head 46 is movable into and out of engagement with the valve seat member 24 between respective closed and open positions of the secondary poppet valve 42. In the closed position, the secondary valve head 56 of the secondary poppet valve 42 engages the secondary valve seat 24*b* of the valve seat member 24 (as shown in FIGS. 1, 2, 8 and 9), while in the open position thereof the secondary valve head 56 is axially spaced from the secondary valve seat 24*b* (a shown in FIGS. 3, 10 and 11). The secondary poppet valve 42 is biased toward the closed position thereof by a secondary valve spring 60 which is non-movably coupled (fixed) to the valve guide 48 at an upper end thereof and to the stem portion 54 of the secondary poppet valve 42 at a lower end of the secondary valve spring 60. Preferably, the secondary valve spring 60 is in the form of a coils spring mounted about the valve stem 44 of the primary poppet valve 40 substantially concentrically thereto. Further preferably, the secondary valve spring 60 is fixed to the valve guide 48 by engaging a helical groove 49 formed thereon and to the secondary valve 42 by engaging a helical groove 59 formed on the stem portion 54. Moreover, the secondary valve head 56 of the secondary poppet valve 42 is complementary to the secondary valve seat 24*b*. Accordingly, when the secondary valve head 56 of the secondary poppet valve 42 engages the secondary valve seat 24*b* of the valve seat member 24 in the closed position thereof (shown in FIGS. 1, 2, 8 and 9), the intake port 20 is blocked and the combustion chamber 15 is hermetically sealed from the intake passage 18.

Therefore, both the primary poppet valve 40 and the secondary poppet valve 42 are continuously (or normally) biased in the closed positions thereof by the primary and secondary valve springs 50 and 60, respectively. Moreover, the primary valve spring 50, being normally contracted, biases the primary poppet valve 40 in the closed position by its expansion force. Conversely, the secondary valve spring 60, being normally extended, biases the secondary poppet valve 42 in the closed position by its contraction force. However, as illustrated in FIG. 2, both the primary and secondary poppet valves 40 and 42 are biased toward their closed positions in the same direction, specifically, in the vertically upward direction. As further illustrated in FIGS. 1, 2, 8 and 9, the intake port 20 is blocked and the combustion chamber 15 is hermetically sealed from the intake passage 18 only when the secondary poppet valve 42 is in the closed position, i.e. when the secondary valve head 56 of the secondary poppet valve 42 engages the secondary valve seat 24*b* of the valve seat member 24. On the other hand, if the primary intake valve 40 is closed, the secondary intake valve 42 is also in its closed position.

Figure 7:
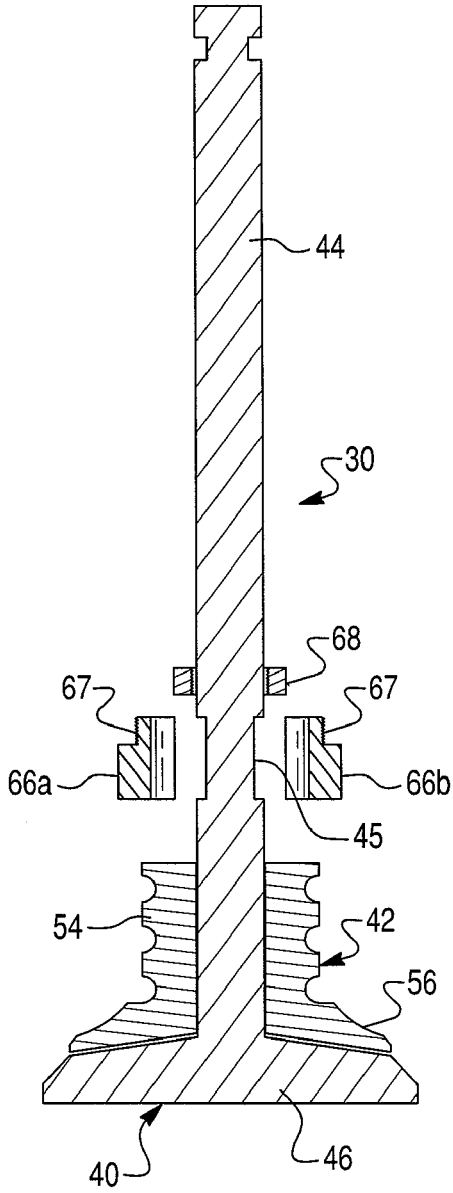
FIG. 7 is an exploded view of the secondary valve lifter according to the preferred embodiment of the present invention.
Figure 8:
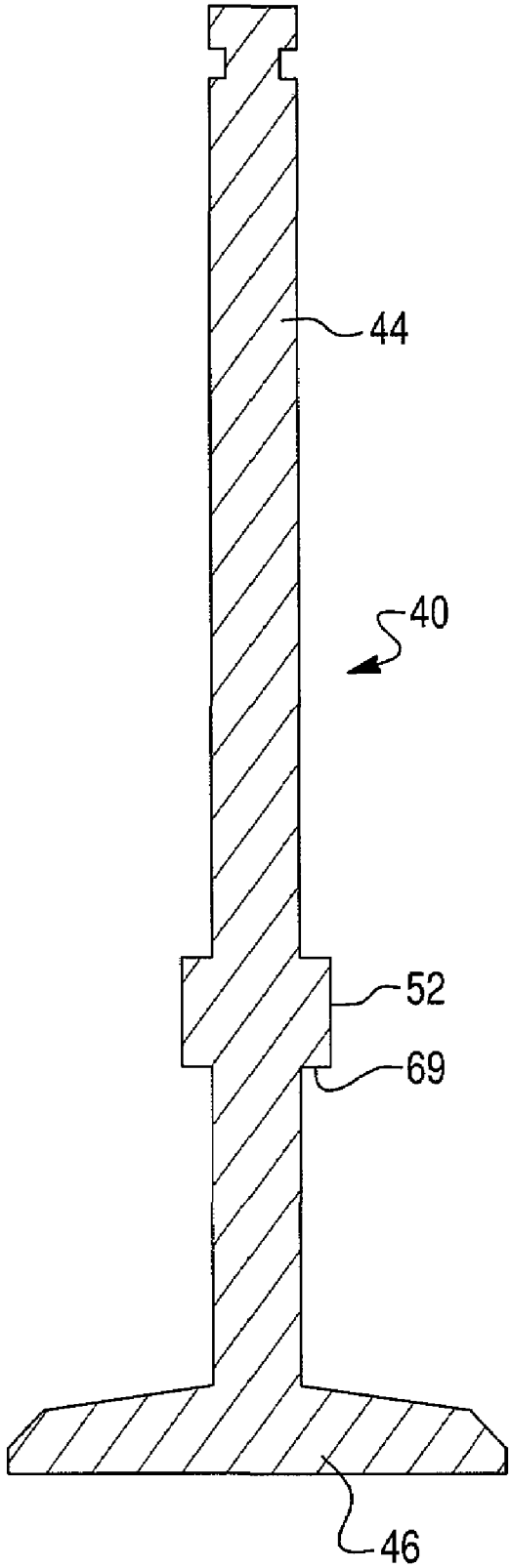
FIG. 8 is a cross-sectional view of the primary poppet valve with the secondary valve lifter formed unitarily with a valve stem of the primary poppet valve according to alternative embodiment of the present invention.

The intake valve assembly 30 further comprises a mechanical secondary valve lifter 52 immovably fixed to the elongated valve stem 44 of the primary poppet valve 40 between the distal ends thereof so as to extend radially outwardly from the valve stem 44, as illustrated in detail in FIGS. 2, 3, 6 and 7. Preferably, the secondary valve lifter 52 is in the form of a substantially cylindrical collar immovably retained in a groove 45 formed in the valve stem 44 by machining. Further preferably, the secondary valve lifter 52 comprises an actuator member 66 and an internally threaded nut member 68 (shown in detail in FIG. 6). The actuator member 66 mates with the groove 45 in the valve stem 44. In turn, the actuator member 66 includes two separate complementary pieces 66*a* and 66*b* each having complementary semi-cylindrical threaded surface 67, as illustrated in FIG. 7. Prior to assembly, the complementary pieces 66*a* and 66*b* of the actuator member 66 are placed in the groove 45 on either side of the valve stem 44, then the nut member 68 is threaded over the threaded surfaces 67 thereof to lock the actuator member 66 in place into the groove 45 in the primary poppet valve 40. Alternatively, the secondary valve lifter 52 can be formed unitarily with the valve stem 44 of the primary poppet valve 40 as a single-piece member, as illustrated in FIG. 8. As further illustrated in FIG. 6, the actuator member 66 of secondary valve lifter 52 has an actuator surface 69 (preferably annular in configuration) provided on axially bottom end thereof so as to extend radially outwardly from the valve stem 44. In turn, the stem portion 54 of the secondary poppet valve 42 has a contact (back) surface 55 (preferably annular in configuration) provided on axially top end thereof and substantially complementary to the actuator surface 69 of the secondary valve lifter 52.

The intake valve assembly 30 is mechanically controlled by the single intake lobe 38*a*. In other words, both the primary and secondary valves 40 and 42, respectively, are actuated by the same (single) cam lobe 38*a*. However, the geometry of the cam lobe is novel to this valve assembly. The primary and secondary valves 40 and 42 are arranged coaxially and linearly (i.e. stacked one on top of the other). Both valves have a clearance area: a valve lash (or valve clearance) of the primary intake valve 40 defined as a distance between a distal end of the valve stem 44 of the primary intake valve 40 and the rocker arm 36*a*, and a valve lash (or valve clearance) of the secondary intake valve 42 defined as a distance between the engagement surface 53 of the secondary valve lifter 52 and the contact surface 55 of the secondary poppet valve 42 in axial direction along the valve stem 44 of the primary poppet valve 40 when both the primary and secondary poppet valves 40 and 42 are in their closed positions. In other words, the valve lash provides a free movement or a distance the valve train has to travel before mechanical contact is achieved.

Conventionally, valve lash is used to ensure a positive seal between the valve and its seat. Accordingly, the valve lash of the primary intake valve 40 is conventional. The mechanical valve timing of the secondary intake valve 42 is just before top dead center and just after bottom dead center. This requires an abnormal amount of distance (or clearance) between the secondary valve lifter 52 fixed to the primary valves stem 44 and the secondary valve 42.

There are mechanical limits to which valve trains can operate valves. An opening ramp on the leading flank of the intake cam lobe starts the intake rocker arm upward rather slowly in the initial stages to take up any residual slack and reduce the shock-loading transferred to the valve train. However, once the valve is moving, it is best to accelerate it at a maximum rate. This same principle holds true in the last stages of closing of the valve. The valve train has to slow the valve down before it returns it down to its seat. In other words, the conventional cam lobe includes the leading flank and the trailing flank having a substantially constant gradient between minimum and maximum lifts.

Because the secondary valve lifter 52, which operates the secondary valve 42, is fixed to the primary valve 40, and the amount of distance required between the secondary valve lifter 52 and the secondary valve 42, a conventional cam profile (with constant gradient) would have a velocity of the secondary valve lifter 52 too high at the time it made contact with the secondary valve 42. Because of this fact, a cam profile of the intake cam lobe 38*a* according to the present invention is designed to accommodate the dual valve assembly. Specifically, the cam profile of the leading flank 38' of the intake cam lobe 38*a* is such that it contacts the primary valve 40 conventionally and starts moving it at a rate that will allow it to slow down and safely contact the secondary valve 42. The same principal is applied to the trailing flank 38" of the intake cam lobe 38*a*. The cam profile of the intake cam lobe 38*a* has to slow down the primary valve 40 to a safe rate to first return the secondary valve 42 to its seat 24*b* then return the primary valve 40 to its seat 24*a*. In other words, the leading flank 38' and the trailing flank 38" of the intake cam lobe 38*a* of the present invention have a variable gradient between minimum and maximum lifts.

Figure 16:
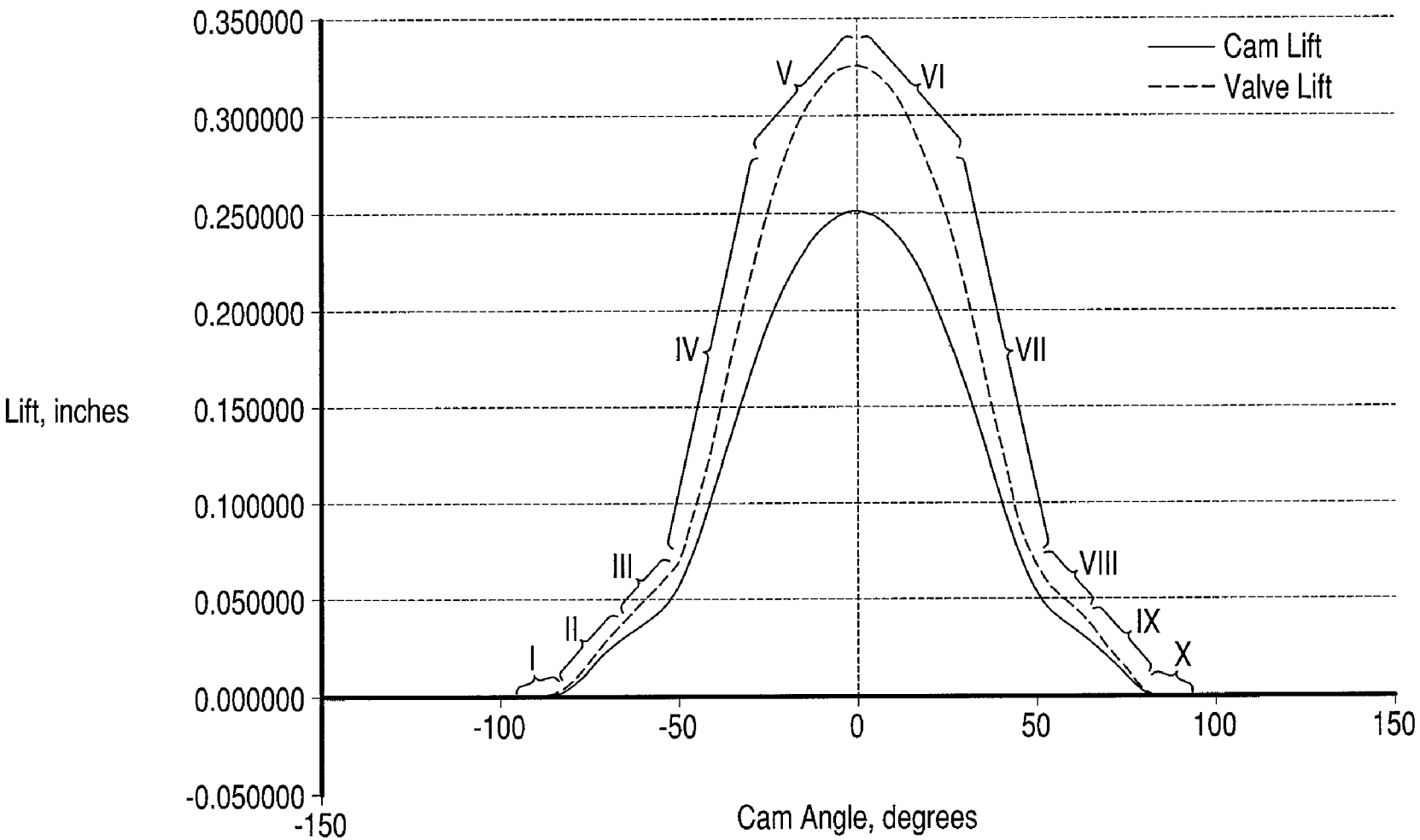
FIG. 16 is a graph of cam and valve lift versus cam angle of an intake cam lobe and the primary poppet valve.

More specifically, as illustrated in FIG. 16, the leading flank 38' of the intake cam lobe 38*a* conventionally starts upward rather slowly in the initial stages to take up any residual slack and reduce the shock-loading transferred to the valve train (segment I of the cam lift, or the opening ramp of the cam lobe profile). Once the primary valve 40 is moving, the gradient of the leading flank 38' increases (segment II of the cam lift of the cam lobe profile) so as to accelerate opening of the primary valve 40. Then, the gradient of the leading flank 38' significantly decreases (segment III of the cam lift) so as to slow down and safely contact the secondary valve 42. Subsequently, the gradient of the leading flank 38' considerably increases again (segment IV of the cam lift) so as to accelerate both the primary valve 40 and the secondary valve 42 at a maximum rate toward their respective open position. When the primary and secondary valves 40 and 42 are reaching their fully open positions, the gradient of the leading flank 38' again decreases (segment V of the cam lift).

Similarly, the gradient of the trailing flank 38" of the intake cam lobe 38*a* first gradually increases (segment VI of the cam lift). Subsequently, the gradient of the trailing flank 38" considerably increases (segment VII of the cam lift) so as to accelerate both the primary valve 40 and the secondary valve 42 at a maximum rate toward their respective closed position. Then, the gradient of the trailing flank 38" significantly decreases (segment VIII of the cam lift) so as to slow down before the secondary valve 42 engages the secondary valve seat 24*b*. Once the secondary valve 42 is safely seated, the gradient of the trailing flank 38" increases again (segment IX of the cam lift) so as to accelerate closing of the primary valve 40. Finally, the gradient of the trailing flank 38" significantly decreases (segment X of the cam lift) so as to slow the primary valve 40 down before it returns it down to its seat 24*a*.

In other words, the leading flank 38' and the trailing flank 38" of the intake cam lobe 38*a* according to the present invention have a variable gradient between minimum and maximum lifts of the primary valve 40.

The primary poppet valve 40 has a fixed duration and lift defined by a geometry (or profile) of the intake lobe 38*a* of the valve actuating cam 38 suitable for high speed performance, while the secondary poppet valve 42 has a variable duration and lift when actuated fluidly (pneumatically) and fixed duration and lift when actuated mechanically suitable for both low and high engine speed performance defined by the geometry of the intake lobe 38*a* of the valve actuating cam 38, by a distance between the engagement surface 53 of the secondary valve lifter 52 and the contact surface 55 of the secondary poppet valve 42 in axial direction along the valve stem 44 of the primary poppet valve 40 when both the primary and secondary poppet valves 40 and 42 are in their closed positions (commonly known in the art as a valve lash or valve clearance), and by a spring rate (coefficient of elasticity) of the secondary valve spring 60. More specifically, the secondary valve 42 is operated mechanically by the secondary valve lifter 52 and fluidly (or pneumatically) in response to pressure differential between the intake passage 18 and the combustion chamber 15. The secondary valve 42 is engagable with the primary valve 40 through the secondary valve lifter 52 after opening of the primary valve 40 so that further movement of the primary valve 40 away from the primary valve seat 24*a* pushes the secondary valve 42 away from the secondary valve seat 24*b*. Free movement of the secondary valve 42 (the amount controlled pneumatically) is always restricted between the secondary valve lifter 52 and the back surface 47 of the valve head 46 of the primary poppet valve 40. Such an arrangement of the intake valve assembly 30 provides the fluidly actuate the secondary intake valve 42 with the ability to operate at high engine speeds. In other words, when the primary valve 40 is fully open—the secondary valve 42 is also opened by the secondary valve lifter 52 (as illustrated in FIG. 3), and when the primary valve 40 is closed—the secondary valve 42 is also closed (as illustrated in FIGS. 1 and 2).

On the other hand, the medium that regulates the variable valve timing of the secondary valve 42 between the two fixed mechanical actuation positions is the pressure and flow of the gas acting directly on the secondary intake valve 42. For the secondary intake valve 42 to work properly in the gas flow, a return spring force of the secondary valve spring 60, i.e. the spring rate) has to be low enough to produce minimum resistance to gas flow. For that reason, and the fact that atmospherically controlled valves cannot be opened early (before top dead center) or closed late (after bottom dead center) the speed range of operation of the secondary valve 42 is very limited without the use of mechanical control. When gas flow and pressure in the intake passage 18 fall below the minimum to open the intake port 20 (usually at the low engine speed), the mechanical valve lifter 52 will open to secondary valve 42 at the fixed point. A similar control is in effect at the intake valve closing. The secondary valve 42 will be returned to the secondary valve seat 24*b* by the cam profile, either against the mechanical valve lifter 52 from its return spring tension or against the back surface 47 of the primary valve 40 from gas flow and pressure in the intake passage 18.

The exhaust valve assembly 32 is substantially conventional and includes an exhaust poppet valve 62 normally biased toward a closed position thereof by an exhaust valve spring 64, as shown in FIG. 1. Preferably, the exhaust valve spring 64 is in the form of a compression coils spring. The exhaust poppet valve 62 has a fixed duration and lift defined by the geometry of the exhaust lobe 38*b* of the valve actuating cam 38.

The operation of the secondary valve 42 is hybrid in nature. In other words, the secondary valve 42 is operated both mechanically by the same intake lobe 38*a* of the valve actuating cam 38 as the primary poppet valve 40 using the secondary valve lifter 52 fixed to the valve stem 44 of the primary poppet valve 40 as its mechanical lifter, and fluidly (or pneumatically) by pressure differential between the intake passage 18 and the combustion chamber 15. Specifically, the secondary poppet valve 42 can be displaced toward its open position either mechanically, when the secondary valve lifter 52 engages the valve stem 44 of the secondary poppet valve 42 due to the movement of the primary poppet valve 40 in an opening direction, or fluidly (pneumatically), when the pressure differential between the intake passage 18 and the combustion chamber 15 reaches a predetermined value capable to overcome the biasing force of the secondary valve spring 60. More specifically, when gas pressure differential between the intake passage 18 and the combustion chamber 15 is higher than the predetermined value to open the secondary poppet valve 42 defined by the spring rate of the secondary valve spring 60 (i.e. the gas pressure in the intake passage 18 is higher than the gas pressure in the combustion chamber 15 and the biasing force of the secondary valve spring 60), the secondary poppet valve 42 would be opened without intervention of the mechanical secondary valve lifter 52 (if the primary poppet valve 40 is open). Also, when gas pressure differential between the intake passage 18 and the combustion chamber 15 falls below the predetermined value to open the secondary poppet valve 42 (i.e. the gas pressure in the intake passage 18 is lower than the gas pressure in the combustion chamber 15 and the biasing force of the secondary valve spring 60), the mechanical secondary valve lifter 52 will open the secondary poppet valve 42 at the fixed point. Similarly, when gas pressure differential between the intake passage 18 and the combustion chamber 15 falls below the predetermined value, the secondary poppet valve 42 will be returned to its seat 24*b* fluidly due to the gas pressure differential or mechanically by the back surface 47 of the valve head 46 of the primary poppet valve 40 due to the spring tension of the primary valve spring 50 as the primary poppet valve 40 moves toward its closed position. Accordingly, the present invention provides in effect a variable valve timing. Also, only minimal low cost modification is required to adapt the intake valve assembly 30 of the present invention to existing engines.

The mechanical opening and closing points of the secondary poppet valve 42 are determined by the distance (or valve clearance) between the secondary valve lifter 52 and the stem portion 54 of the secondary poppet valve 42 when both the primary and secondary poppet valves 40 and 42 are in their closed positions. The fluid operated opening and closing duration and a lift rate of the secondary poppet valve 42 are determined by the spring rate of the secondary valve spring 60, opposing the pressure and flow differential of gases between the intake passage 18 and the combustion chamber 15.

Figure 9:
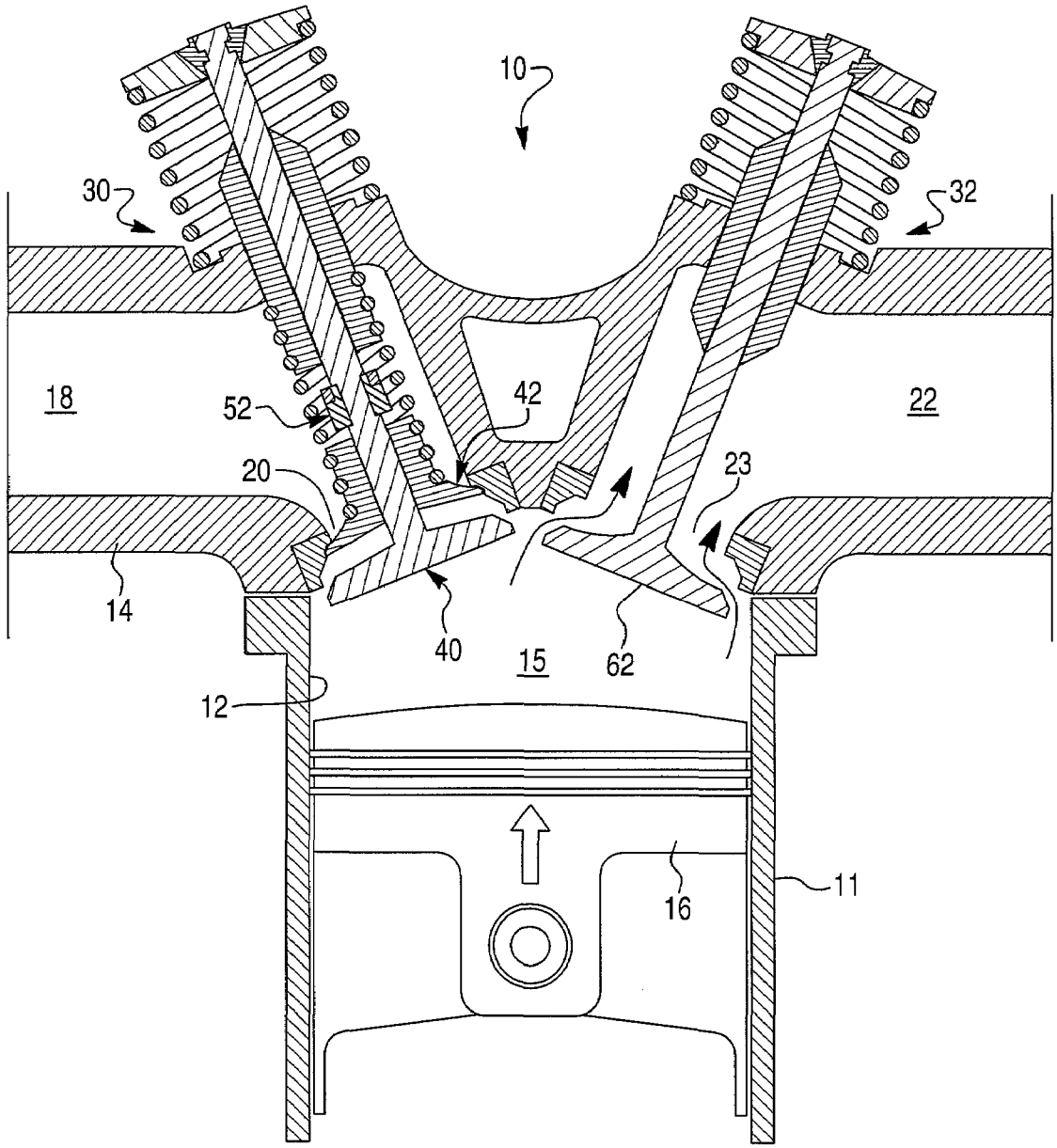
FIG. 9 is a fragmentary, sectional transverse view of the internal combustion engine according to the preferred embodiment of the present invention during valve overlap at low engine speed.
Figure 10:
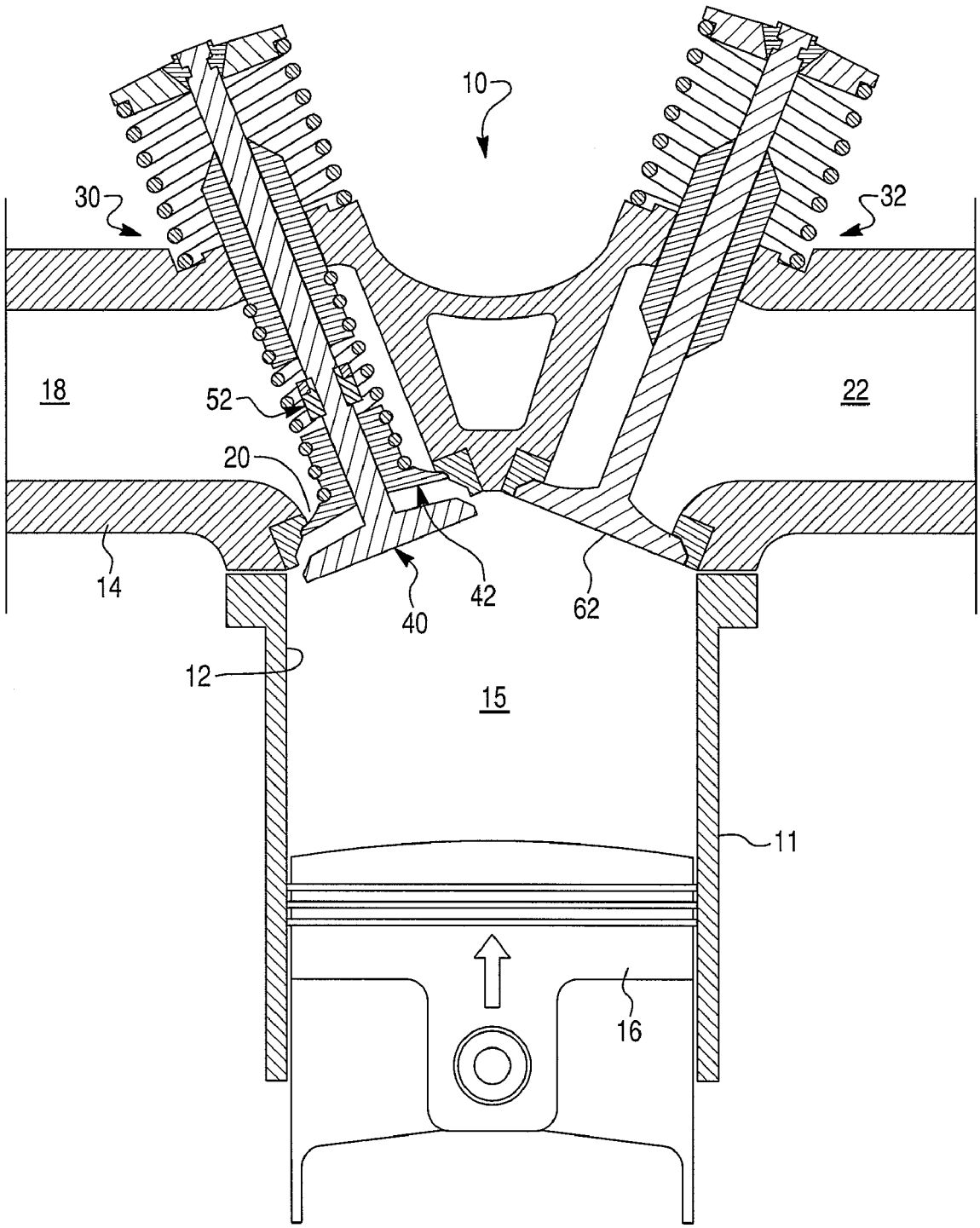
FIG. 10 is a fragmentary, sectional transverse view of the internal combustion engine according to the preferred embodiment of the present invention during a crossover phase from an intake stroke to a compression stroke at low engine speed.

The operation of the intake valve assembly 30 of the present invention at low speeds of the engine 10, illustrated in FIGS. 9 and 10, is as follows.

FIG. 9 illustrates the valve overlap (i.e. the overlap of the ending phase of the exhaust stroke and the beginning phase of the intake stroke) at low engine speed when the piston 16 is moving up and is near its top dead center (TDC) position. During this time, the combustion chamber 15 is filled with exhaust gas, and the exhaust poppet valve 62 is still open to enable the exhaust gas to escape from the combustion chamber 15. As the piston 16 is reaching its top dead center (TDC) position to begin the intake stroke, the valve actuating mechanism 34 for the associated intake valve assembly 30 is operated so that the valve stem 44 of the primary poppet valve 40 is pushed downwardly in an opening direction by the cam lobe 38*a* and the first rocker arm 36*a* forcing the primary poppet valve 40 away from the primary valve seat 24*a* through the closed secondary poppet valve 42, thus producing a reduced valve overlap period wherein both the primary intake poppet valve 40 and the exhaust poppet valve 62 are simultaneously open (as compared to conventional engines). However, initially, as the primary poppet valve 40 moves downwardly, the secondary poppet valve 42 remains seated on the secondary valve seat 24*b* due to the biasing force of the secondary valve spring 60. At the same time, as the pressure of the exhaust gas in the combustion chamber 15 is higher than the pressure of the air-fuel mixture in the intake passage 18 at the low engine speeds, the secondary intake poppet valve 42 is pressed against the secondary valve seat 24*b* by the pressure differential between the combustion chamber 15 and the intake passage 18. It will be appreciated that during this phase of the intake stroke, although the primary poppet valve 40 is open, the intake port 20 is blocked by the secondary poppet valve 42 so as to prevent fluid communication between the combustion chamber 15 and the intake passage 18, thus preventing back-flow of exhaust gas through the intake port 20 into the intake passage 18 and, consequently, dilution of the air-fuel mixture in the intake passage 18. This, in turn, increasing fuel economy and reduces exhaust emission.

Therefore, during the reduced valve overlap period at low engine speeds, the secondary poppet valve 42 is closed until the secondary valve lifter 52 engages the valve stem 44 of the secondary poppet valve 42 due to the movement of the primary poppet valve 40 in an opening direction. Further downward movement of the primary poppet valve 40 (in the opening direction) opens the secondary poppet valve 42, which opens the intake port 20 and provides fluid communication between the combustion chamber 15 and the intake passage 18.

FIG. 10 illustrates a crossover phase from the intake stroke to the compression stroke at low engine speed when the engine 10 has reached the end of the intake stroke and the piston 16 is just started moving up to compress the gas in the combustion chamber 15 and is near its bottom dead center (BDC) position. During this time, the combustion chamber 15 is filled with the air-fuel mixture, the exhaust valve 62 is closed, while the primary poppet valve 40 is closing but still off the primary valve seat 24*a*. As the piston 16 is rising and compressing the air-fuel mixture, the gas pressure in the cylinder 12 increases well above the gas pressure inside the intake passage 18. It should be appreciated that at the low engine speeds the speed of the gas flow, thus the pressure, in the intake passage 18 is relatively low. Therefore, the gas pressure in the intake passage 18 is not enough to overcome the gas pressure in the combustion chamber 15 and the closing biasing force of the secondary valve spring 60. The gas pressure differential between the intake passage 18 and the combustion chamber 15 and the biasing force of the secondary valve spring 60 presses the secondary intake poppet valve 42 against the secondary valve seat 24*b*. It will be appreciated that during this phase of the intake stroke, although the primary poppet valve 40 is still open, the intake port 20 is blocked by the secondary poppet valve 42 so as to prevent fluid communication between the combustion chamber 15 and the intake passage 18, thus preventing reverse pulsing of the air-fuel mixture through the intake port 20 back into the intake passage 18 and, consequently, improving engine torque and power.

Therefore, the intake valve assembly 30 of the present invention in effect reduces the valve open duration at low engine speeds as compared to conventional engines.

Figure 11:
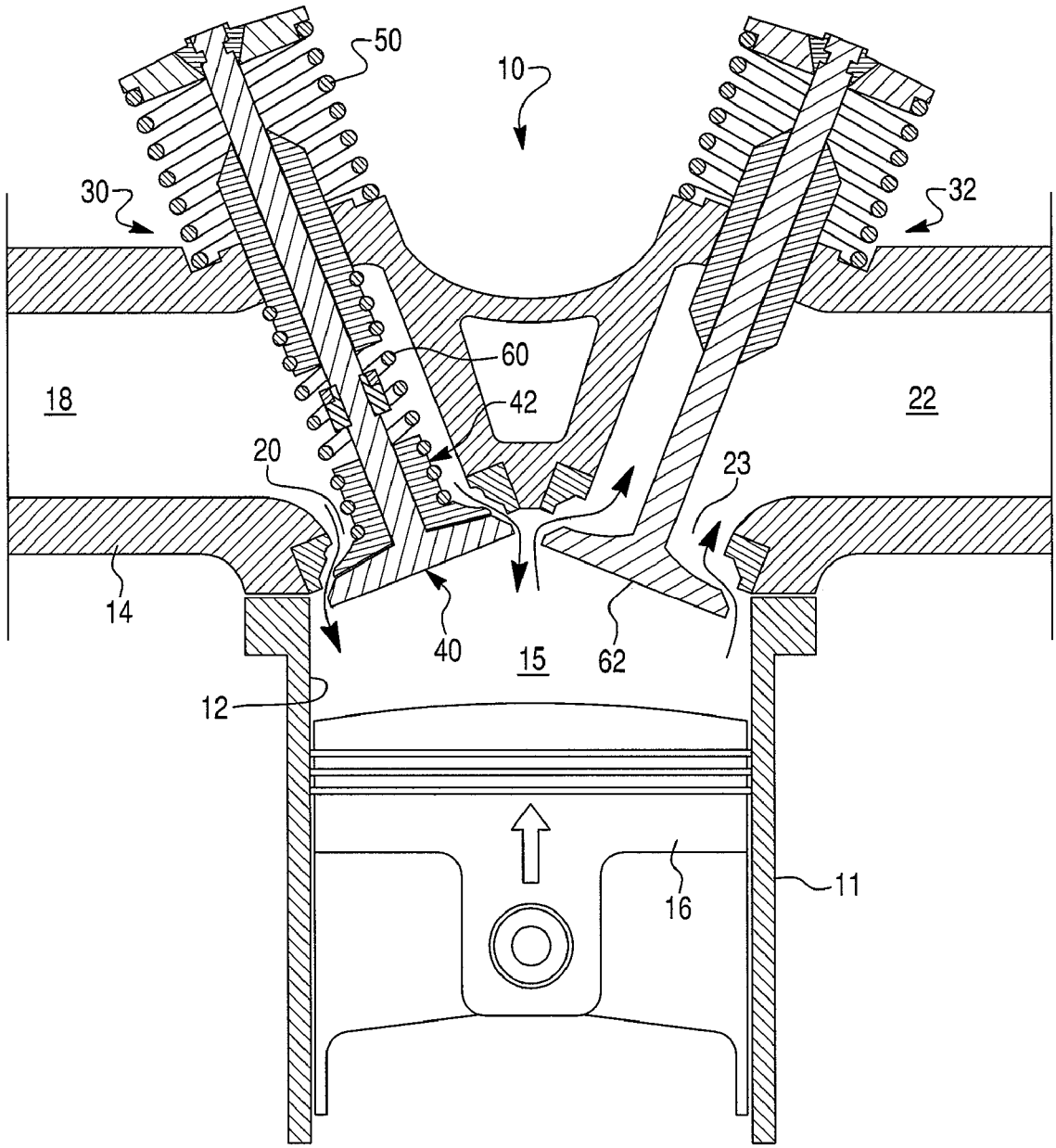
FIG. 11 is a fragmentary, sectional transverse view of the internal combustion engine according to the preferred embodiment of the present invention during valve overlap at high engine speed.
Figure 12:
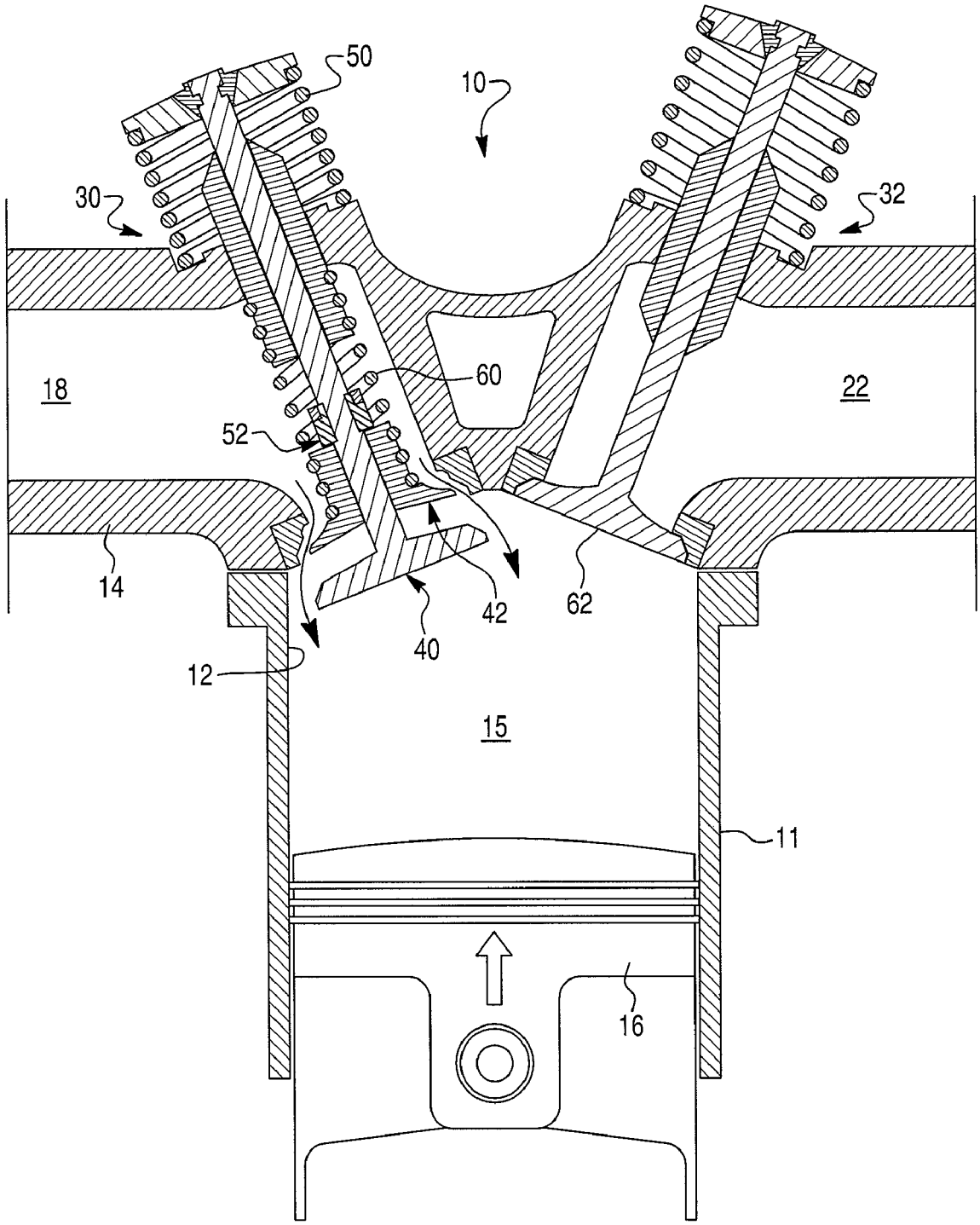
FIG. 12 is a fragmentary, sectional transverse view of the internal combustion engine according to the preferred embodiment of the present invention during the crossover phase from the intake stroke to the compression stroke at high engine speed.

The operation of the intake valve assembly 30 of the present invention at high speeds of the engine 10, illustrated in FIGS. 11 and 12, is as follows.

FIG. 11 illustrates the valve overlap (i.e. the overlap of the ending phase of the exhaust stroke and the beginning phase of the intake stroke) at high engine speed when the piston 16 is moving up and is near its TDC position. During this time, the exhaust poppet valve 62 is still open to enable the exhaust gas to escape from the combustion chamber 15, but is quickly closing. As the piston 16 is moving up toward its TDC position to conduct the intake stroke, the valve actuating mechanism 34 for the associated intake valve assembly 30 is operated so that the valve stem 44 of the primary poppet valve 40 is pushed downwardly in an opening direction by the cam lobe 38*a* and the first rocker arm 36*a* forcing the primary poppet valve 40 away from the primary valve seat 24*a* through the secondary poppet valve 42. As the primary intake poppet valve 40 moves downwardly, the secondary intake poppet valve 42 is rapidly opening, thus increasing valve overlap period (as compared to the engine operation at low engine speeds), because at the high engine speeds the fluid pressure in the intake passage 18 is well above the pressure in the combustion chamber 15. FIG. 11 illustrates the beginning phase of the intake stroke during the high speed engine operation, when the primary intake valve 40 is opening, while the secondary intake valve 42 is fluidly opening earlier than during the same valving phase at low engine speeds. In other words, when the primary intake valve 40 is opening at high engine speeds, the secondary intake valve 42 is opening simultaneously as the high pressure differential between the intake passage 18 and the combustion chamber 15 (due to the high speed of the exhaust flow) as the piston 16 reaches TDC and is reversed at a high rate of acceleration of the intake flow velocity keeps the secondary intake valve 42 open against the back surface 47 of the valve head 46 of the primary poppet valve 40. This improves volumetric efficiency and a high end power of the engine 10.

FIG. 12 illustrates a crossover phase from the intake stroke to the compression stroke at high engine speed. The piston 16 has just completed its downward travel at very high velocity, and has just reached its BDC position. For that reason, the gas pressure in the combustion chamber 15 is well below the gas pressure in the intake passage 18. During this time, the exhaust poppet valve 62 is closed, and the piston 16 is moving up toward its TDC position to perform the compression stroke. In the initial phase of the compression stroke the air-fuel mixture continues to fill the cylinder 12 against the rising piston 16. The still high pressure of the air-fuel mixture flowing through the intake passage 18 keeps the secondary intake valve 42 open against the primary intake valve 40. The primary intake valve 40 and, correspondingly, the secondary intake valve 42, are timed to close before the air-fuel mixture flow reverses.

Therefore, the intake valve assembly 30 of the present invention reduces the opening angle and timing of the secondary intake valve 42 at the low engine speeds so as to improve low speed performance and fuel economy of the internal combustion engine, and increases the opening angle and timing of the intake port of the secondary intake valve 42 at high engine speeds to improve a peak power output. Accordingly, the intake valve assembly 30 of the present invention provides in effect a variable valve timing.

Figure 13:
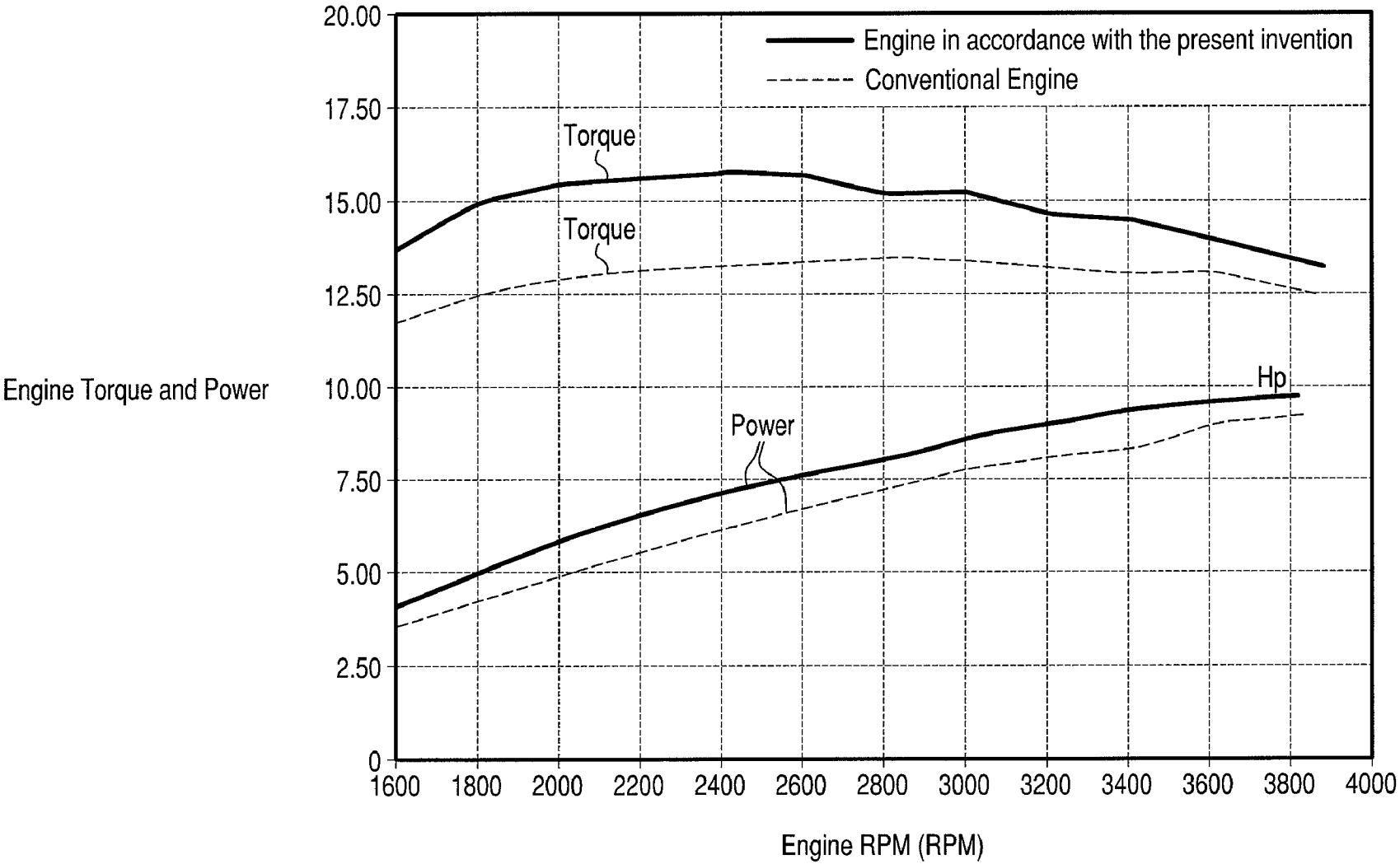
FIG. 13 shows comparison diagrams of engine torque and power for a conventional stock engine and the engine equipped with the intake valve assembly of the present invention.

Comparison diagrams of engine torque and power for the conventional stock engine and the improved engine equipped with the intake valve assembly of the present invention are shown in FIG. 13. Detailed dynamometer test results are shown in FIGS. 14 (for stock engine) and 15 (for test engine equipped with the intake valve assembly of the present invention). The tested stock engine is a single cylinder, four-stroke engine having an engine displacement 19.02 $in^3$. The test engine is the same single cylinder engine having the intake valve assembly of the present invention.

Therefore, the present invention provides a novel intake valve assembly of an internal combustion engine that provides in effect variable valve timing and significantly improves both low and high speed performance of the engine, reduces emissions and improves fuel economy. Moreover, the present invention requires minimal low cost modification to adapt this invention to existing engines.

The foregoing description of the preferred embodiment of the present invention has been presented for the purpose of illustration in accordance with the provisions of the Patent Statutes. It is not intended to be exhaustive or to limit the invention to the precise forms disclosed. The embodiments disclosed hereinabove were chosen in order to best illustrate the principles of the present invention and its practical application to thereby enable those of ordinary skill in the art to best utilize the invention in various embodiments and with various modifications as suited to the particular use contemplated, as long as the principles described herein are followed. This application is therefore intended to cover any variations, uses, or adaptations of the invention using its general principles. Further, this application is intended to cover such departures from the present disclosure as come within known or customary practice in the art to which this invention pertains. Thus, changes can be made in the above-described invention without departing from the intent and scope thereof. It is also intended that the scope of the present invention be defined by the claims appended thereto.

What is claimed is:

1. An intake valve assembly of an internal combustion engine including a combustion chamber and an intake passage fluidly communicating with said combustion chamber through an intake port, said intake valve assembly comprising:

a primary valve provided to seal against a primary valve seat formed in said intake port;

said primary valve being movable into and out of engagement with said primary valve seat between respective closed and open positions so that in said closed position of said primary poppet valve said combustion chamber being sealed from said intake passage;

a hollow secondary valve mounted about said primary valve substantially coaxially therewith and provided to seal against a secondary valve seat formed in said intake port;

said secondary valve being movable into and out of engagement with said secondary valve seat between respective closed and open positions so that in said closed position of said secondary valve said combustion chamber being sealed from said intake passage; and a secondary valve lifter fixed to said primary valve so as to be axially spaced from said secondary valve when both said primary valve and said secondary valve are in said closed position;

said secondary valve being operated both mechanically by said secondary valve lifter and fluidly in response to pressure differential between said intake passage and said combustion chamber;

said secondary valve being engagable with said primary valve through said secondary valve lifter after opening of said primary valve so that further movement of said primary valve away from said primary valve seat moving said secondary valve away from said secondary valve seat.

2. The intake valve assembly as defined in claim 1, further comprising a primary valve spring for normally biasing said primary valve toward said closed position thereof and a secondary valve spring for normally biasing said secondary valve toward said closed position thereof.

3. The intake valve assembly as defined in claim 2, wherein said primary valve is a poppet valve including an elongated stem and a primary valve head provided to seal against said primary valve seat formed in said intake port; said primary valve head is complementary to said primary valve seat.

4. The intake valve assembly as defined in claim 3, wherein said secondary valve is a poppet valve including a stem portion, a secondary valve head provided to seal against said secondary valve seat formed in said intake port and a substantially cylindrical bore extending through both said stem portion and said secondary valve head of said secondary poppet valve; said secondary valve head is complementary to said secondary valve seat.

5. The intake valve assembly as defined in claim 4, wherein said secondary valve head of said secondary valve is shaped so that a front surface thereof is configured to complement and nest over a back surface of said primary valve head of said primary valve.

6. The intake valve assembly as defined in claim 5, wherein said secondary valve head of said secondary valve is dome-shaped.

7. The intake valve assembly as defined in claim 4, wherein said secondary valve lifter is immovably fixed to said elongated valve stem of said primary valve between the distal ends thereof; said secondary valve lifter having an actuator surface provided on axially bottom end thereof; said actuator surface of said secondary valve lifter is axially spaced from a complementary contact surface provided on axially top end of said stem portion of said secondary valve when both said primary valve and said secondary valve are in said closed position.

8. The intake valve assembly as defined in claim 7, wherein said secondary valve lifter is immovably retained in an annular groove formed in said valve stem of said primary valve.

9. The intake valve assembly as defined in claim 8, wherein said secondary valve lifter comprises an actuator member mating with said annular groove in said valve stem and an internally threaded nut member.

10. The intake valve assembly as defined in claim 9, wherein said actuator member includes two complementary pieces each having complementary semi-cylindrical threaded surface; said two complementary pieces of said actuator member are threadedly engaged by said internally threaded nut member to lock said actuator member in place into said annular groove in said primary valve.

11. The intake valve assembly as defined in claim 8, wherein said secondary valve lifter is in the form of a substantially cylindrical collar; and wherein said stem portion of said secondary valve is substantially cylindrical in shape.

12. The intake valve assembly as defined in claim 2, wherein said primary valve spring is normally contracted for continuously biasing said primary valve toward said closed position thereof; and wherein said secondary valve spring is normally extended for continuously biasing said secondary valve toward said closed position thereof.

13. The intake valve assembly as defined in claim 3, wherein said primary valve spring is in the form of a coil spring mounted about said elongated stem of said primary valve.

14. The intake valve assembly as defined in claim 13, wherein said secondary valve spring is in the form of a coil spring mounted about said elongated stem of said primary valve in said intake passage.

15. The intake valve assembly as defined in claim 14, wherein said secondary valve spring is non-movable coupled to said stem portion of said secondary valve at a lower end of said secondary valve spring.

16. The intake valve assembly as defined in claim 15, further comprising a valve guide supporting said elongated stem of said primary valve for reciprocatingly sliding said primary valve between said closed and open positions thereof.

17. The intake valve assembly as defined in claim 16, wherein said secondary valve spring is non-movable coupled to said valve guide at an upper end of said secondary valve spring.

18. The intake valve assembly as defined in claim 1, wherein said primary valve seat is larger in cross-section than said secondary valve seat.

19. The intake valve assembly as defined in claim 1, further comprising an intake cam lobe having a fixed cam profile including a leading flank and a trailing flank; said leading flank has a variable gradient such that said primary valve slows down before said secondary valve lifter contacts said secondary valve.

20. The intake valve assembly as defined in claim 19, wherein said trailing flank has a variable gradient such that said primary valve slows down before said secondary valve engages said secondary valve seat.

* * * * *